US012515767B2

(12) United States Patent
Macfarlane-Barrow

(10) Patent No.: US 12,515,767 B2
(45) Date of Patent: Jan. 6, 2026

(54) VESSEL ATTITUDE CONTROL SUPPORT ARRANGEMENT

(71) Applicant: Nauti-Craft Ltd, Dunsborough (AU)

(72) Inventor: Liam Peter Macfarlane-Barrow, West Busselton (AU)

(73) Assignee: NAUTI-CRAFT LTD, Dunsborough (AU)

( * ) Notice: Subject to any disclaimer, the term of this patent is extended or adjusted under 35 U.S.C. 154(b) by 528 days.

(21) Appl. No.: 17/996,707

(22) PCT Filed: Apr. 23, 2021

(86) PCT No.: PCT/AU2021/050371
§ 371 (c)(1),
(2) Date: Oct. 20, 2022

(87) PCT Pub. No.: WO2021/212184
PCT Pub. Date: Oct. 28, 2021

(65) Prior Publication Data

US 2023/0312062 A1 Oct. 5, 2023

(30) Foreign Application Priority Data

Apr. 24, 2020 (AU) ..... 2020901305

(51) Int. Cl.
*B63B 39/00* (2006.01)
*B63B 1/14* (2006.01)
(Continued)

(52) U.S. Cl.
CPC ..... *B63B 39/00* (2013.01); *B63B 1/14* (2013.01); *B63B 79/10* (2020.01); *B63B 79/40* (2020.01); *B63B 2001/145* (2013.01)

(58) Field of Classification Search
CPC ..... B63B 39/00; B63B 39/04; B63B 1/14; B63B 2001/209; B63B 2001/145;
(Continued)

(56) References Cited

U.S. PATENT DOCUMENTS 6,010,139 A 1/2000 Heyring et al.
6,176,190 B1 1/2001 Ozga
(Continued)

FOREIGN PATENT DOCUMENTS

CN 207889950 9/2018
FR 2450192 9/1980
(Continued)

OTHER PUBLICATIONS

Foreign Reference (Year: 2015).*

*Primary Examiner* — Daniel V Venne
(74) *Attorney, Agent, or Firm* — Allen, Dyer, Doppelt + Gilchrist, PA

(57) ABSTRACT

A suspension system for a vessel with at least one left hull, at least one right hull and a chassis, the suspension system including respective front left, front right, back left and back right support rams connected between the chassis and the respective hull and including a respective compression chamber which with a respective diagonal conduit forms a respective support compression volume; first digonal support interconnection valve (59) selectively interconnects front left and back right diagonal conduits (61, 64) and support compression volumes second diagonal support interconnection valve (60) selectively interconnects front right and back left diagonal conduits (62, 63) and support compression volumes, a deck attitude control system (100) comprising a controller (102), sensors, first and second diagonal actuating arrangements (25, 26) for controlling fluid flow across the respective diagonal support intercon-
(Continued)

nection valve to control a position of a point on the chassis relative to a reference (5).

11 Claims, 4 Drawing Sheets

(51) Int. Cl.
*B63B 79/10* (2020.01)
*B63B 79/40* (2020.01)

(58) Field of Classification Search
CPC ... B63B 2003/085; B63B 79/10; B63B 79/40; B63B 2017/0072; B63B 27/30

USPC ..... 114/121, 271, 278, 279, 283, 284
See application file for complete search history.

(56) References Cited

U.S. PATENT DOCUMENTS

| | | | | |
|---|---|---|---|---|
| 7,314,014 | B2 * | 1/2008 | Heyring | B63B 39/005 114/61.15 |
| 9,061,735 | B2 * | 6/2015 | Heyring | B63B 39/00 |
| 9,849,947 | B2 * | 12/2017 | Longman | B63B 27/30 |
| 10,286,980 | B2 * | 5/2019 | Monk | B63B 27/14 |
| 10,315,736 | B2 * | 6/2019 | Monk | B63B 39/00 |
| 2006/0144311 | A1 | 7/2006 | Heyring | |
| 2009/0227159 | A1 | 9/2009 | Meyer | |
| 2013/0213288 | A1 | 8/2013 | Hall | |
| 2019/0092435 | A1 | 3/2019 | Longman | |

FOREIGN PATENT DOCUMENTS

| | | | | |
|---|---|---|---|---|
| WO | WO9836923 | | 8/1998 | |
| WO | WO 2011/143694 | | 11/2011 | |
| WO | WO 2014/153600 | | 10/2014 | |
| WO | WO-2015085352 | A1 * | 6/2015 | B63B 27/30 |
| WO | WO 2016/081990 | | 6/2016 | |
| WO | WO 2020/113287 | | 6/2020 | |

* cited by examiner

VESSEL ATTITUDE CONTROL SUPPORT ARRANGEMENT

TECHNICAL FIELD

The present invention relates to vessels having a body or chassis and movable hulls and specifically relates to a suspension system between the body or chassis and at least two such movable hulls.

BACKGROUND

It is known to control the attitude of a body or chassis of a vessel relative to the hulls which support it, at least in part. For example, in the Applicant's U.S. Pat. No. 9,061,735 there is a vessel having a body or chassis supported at least in part relative to a left hull and a right hull. When the vessel is a catamaran, so the body or chassis is completely above the surface of the water, then support is performed by a suspension system between the body or chassis and the left and right hulls. Conversely, when the body or chassis engages the water, such as including a central hull portion, said water-engaging central hull supports part of the mass of the body or chassis, with the remainder or partial support being provided by the suspension system between the body or chassis and the left and right hulls. In either case the pitch attitude and roll attitude of the body or chassis can be adjusted by controlling the suspension system.

The attitude of the body or chassis of the vessel can be controlled to minimise lateral, longitudinal, vertical and/or roll displacement between a point on the body or chassis and a reference point on an object. This can be particularly useful during transfer of personnel or goods between the vessel and the object. For example, in the Applicant's U.S. Pat. No. 9,849,947 the reference point can be a point on a pylon, dock or other vessel. The reference point can also be an absolute point in space.

As discussed in the Applicant's U.S. Pat. No. 10,286,980 the attitude of the body or chassis can be controlled to minimise lateral forces felt on the body or chassis of the vessel by adjusting the roll attitude of the body or chassis such that the line of action of the resultant of gravitational and centrifugal forces experienced by the body or chassis remains substantially perpendicular to the deck of the vessel. For example, when the vessel is turning, the body or chassis can be rolled into the turn, providing roll-in functionality.

In the Applicant's as International Patent Application publication number WO2020/113287 there is disclosed a diagonal pumping arrangement in which fluid is pumped between diagonally opposed rams to enable adjustment of both the roll and pitch attitude of the body or chassis of a vessel. However, the energy losses of pumps suitable for this application are not insignificant.

It would therefore be desirable to provide a suspension system which enables adjustment or control of the attitude of the body or chassis of a vessel relative to at least two movable hulls, whilst overcoming one or more disadvantages of the above or at least providing an alternative suspension system.

SUMMARY OF INVENTION

According to a first aspect of the invention there is provided a suspension system for a vessel, the vessel having at least one left hull, at least one right hull and a chassis portion: the suspension system including locating arrangements for constraining motion of the left and right hulls in at least a longitudinal and a lateral direction relative to the chassis portion and supports for at least partially supporting the chassis portion relative to the at least one left hull and at least one right hull; the supports including a front left support ram, a front right support ram, a back left support ram and a back right support ram, each respective support ram including at least a respective support compression chamber forming at least part of a respective support compression volume; the front left support ram and the back left support ram being directly or indirectly connected between the chassis portion and longitudinally spaced points on the at least one left hull, and the front right support and back right support being directly or indirectly connected between the chassis portion and longitudinally spaced points on the at least one right hull; a front left diagonal conduit connected to and forming part of the front left support compression volume, a front right diagonal conduit connected to and forming part of the front right support compression volume, a back left diagonal conduit connected to and forming part of the back left support compression volume, a back right diagonal conduit connected to and forming part of the back right support compression volume; wherein the front left and back right support compression volumes are selectively interconnected by a first diagonal support interconnection valve between the front left diagonal conduit and the back right diagonal conduit, and the front right and back left support compression volumes are selectively interconnected by a second diagonal support interconnection valve between the front right diagonal conduit and the back left diagonal conduit; the suspension system further includes a deck attitude control system comprising a controller, at least one respective force, pressure, acceleration, orientation or position sensor, a first diagonal actuating arrangement for controlling fluid flow between the front left and back right support compression volumes, and a second diagonal actuating arrangement for controlling fluid flow between the front right and back left support compression volumes; the first diagonal actuating arrangement including the first diagonal support interconnection valve and the second diagonal actuating arrangement including the second diagonal support interconnection valve; the controller, in use (or in operation), controlling the first and second diagonal actuating arrangements in dependence on signals from the at least one force, pressure, acceleration, orientation or position sensor to control a position of at least one point on the chassis relative to at least one reference.

Any of the support rams may be directly connected between the chassis portion and the associated hull, or indirectly connected therebetween, such as being connected between the chassis portion and the locating arrangements.

The controller may control the first and second actuating arrangements to control the attitude of the suspension system whenever the vessel is in use, or even when it is not in use but can benefit from ensuring that the deck or chassis portion remain substantially level and the vessel does not adopt too large of a lean angle. For example, the controller may provide a periodic suspension maintenance function using the first and second actuating arrangements even when the deck attitude control system is not fully operational. Alternatively, the controller may control the actuating arrangements when the deck attitude control system is in operation fully, for example when the deck attitude is required to be controlled such as when stationary and the deck is required to remain substantially level, or for example when the vessel is docking with a pylon, dock, vessel or other object in which case a point on the deck may be controlled vertically relative to a point on the object, or for example to provide roll-in functionality when turning.

The front left, front right, back left and back right support rams may each include a respective rebound chamber. For example, the support rams may be double-acting rams. The front left, front right, back left and support rams may be respectively interconnected by respective lateral cross connections: the front left support compression chamber of the front left support ram being connected to a front right support rebound chamber of the front right support ram by a front left compression conduit forming part of the front left support compression volume; the front right support compression chamber of the front right support ram being connected to a front left support rebound chamber of the front left support ram by a front right compression conduit forming part of the front right support compression volume; the back left support compression chamber of the back left support ram being connected to a back right support rebound chamber of the back right support ram by a back left compression conduit forming part of the back left support compression volume; and the back right support compression chamber of the back right support ram being connected to a back left support rebound chamber of the back left support ram by a back right compression conduit forming part of the back right support compression volume.

The supports may further include additional low stiffness independent support rams. For example, the independent low stiffness support rams may be air springs. The such low stiffness independent support rams may vary in pressure (for example static, or non-dynamic pressure) by less than 25%, preferably less than 20%, more preferably less than 15% and most preferably less than 10%, through a range of at least 50%, preferably at least 60%, more preferably at least 70% and most preferably at least 80% of a travel of the support. The low stiffness independent support rams may vary in support force by less than 25%, preferably less than 20% more preferably less than 15% and most preferably less than 10%, through a range of at least 50%, preferably at least 60%, more preferably at least 70% and most preferably at least 80% of a travel of the support.

The suspension system may further include damper rams. For example, the damper rams may be integrated into the support rams or provided separately, such as in parallel with the support rams. Such damper rams may provide a controlled, variable amount of damping force and the damping force may be varied in dependence on operation of the deck attitude control system.

The first diagonal actuating arrangement may include a front left support compression volume control valve and a back right support compression volume control valve, the second diagonal actuating arrangement may include a front right support compression volume control valve and a back left support compression volume control valve, each respective support compression volume control valve selectively communicating the respective support compression volume with a pressure source or a tank. The respective support compression volume control valves can therefore adjust the pressure and/or volume of fluid in the respective support compression volume, either continuously at high flow rates for active control of the chassis portion in an active mode, or periodically and/or at low flow rates to provide a levelling or attitude correction function for the suspension system.

The first diagonal actuating arrangement may include a first pump to drive fluid between the front left support compression volume and the back right support compression volume, and the second diagonal actuating arrangement may include a second pump to drive fluid between the front right support compression volume and the back left support compression volume. The first and second pumps may be bi-directional and/or reversible. Optionally, a respective lockout valve may be provided in series with each of the first and second pumps.

Said selective interconnection may be opened during a deck attitude control system operation and closed when the deck attitude control system is not in use. For example, said selective interconnection may be open during at least one deck attitude control system operation such as when the controller is controlling the actuating arrangements during transfer. Similarly, said selective interconnection may be closed when the deck attitude control system is not in use such as during transit.

The at least one respective force, pressure, acceleration, orientation or position sensor may provide at least one respective output signal from which a force in the respective support ram may be calculated. The at least one parameter may be a mount force or may be fluid pressures in a compression (or compression and rebound chambers) of the respective support ram. Alternatively or additionally, the at least one respective force, pressure, acceleration, orientation or position sensor may provide at least one respective output signal indicative of a displacement of the respective damper ram and/or an orientation of the chassis portion.

For example, the position sensor may provide an indication of a displacement of a ram and/or a location of a hull relative to the chassis portion and/or a location of the at least one reference relative to a point on the chassis portion. The at least one reference may be a point on an object, an absolute point in space or an orientation of the chassis portion. For example, the at least one reference point on an object may be at least one point on a pylon, dock or another vessel or other object. An orientation sensor may provide an indication of an orientation or absolute angle of the chassis portion or a deck thereof. For example the orientation may be an absolute pitch orientation or absolute pitch angle (i.e. relative to ground) and/or an absolute roll orientation or absolute roll angle (i.e. relative to ground).

Each of the first and second diagonal actuating arrangements may be controlled by the controller such that the first and second diagonal support interconnection valves provide a flow between the associated support compression volumes that corresponds to a flow required by the controller up to an instantaneous limit flow determined in part by a velocity or rate of displacement of the support rams and by the pressure differential across the first or second diagonal support interconnection valves, beyond which power, one or both of the diagonal support interconnection valves may be closed and the required fluid displacements between the associated support compression volumes is supplied by the support compression volume control valves or the first or second pumps of the respective diagonal actuating arrangements to provide a powered flow that corresponds to a flow required by the controller.

It will be convenient to further describe the invention by reference to the accompanying drawings which illustrate preferred aspects of the invention. Other embodiments of the invention are possible and consequently particularity of the accompanying drawings is not to be understood as superseding the generality of the preceding description of the invention.

DESCRIPTION OF PREFERRED EMBODIMENT

Figure 1:
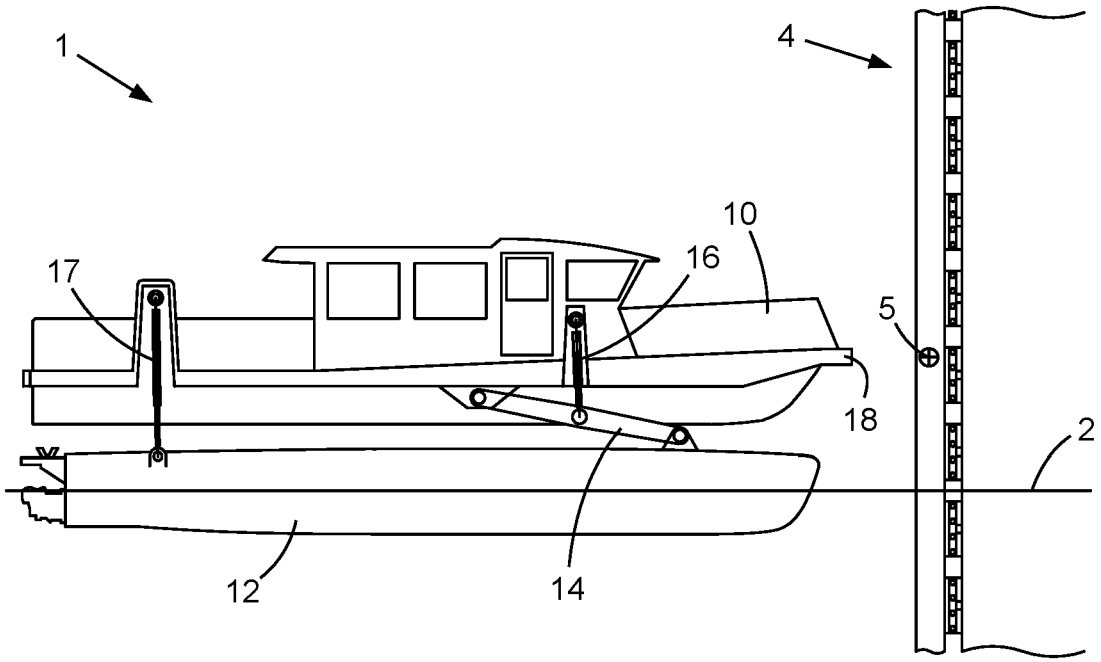
FIG. 1 is a side view of a vessel according to an embodiment of the present invention.

Referring initially to FIG. 1, there is shown a vessel 1 with a left hull (not shown) and a right hull 12 engaged in water 2. The present invention provides a deck attitude control system for controlling the attitude of the deck of the vessel 2 or for controlling the position of a point on the vessel relative to a point on an object or its absolute position or orientation in space. The vessel 2 is adjacent a pylon 4, so one possible use of the deck attitude control system is to minimise the relative vertical distance between a point on the vessel such as the bow 18 and a reference point 5 on the pylon 4.

The term chassis portion is intended to include the chassis or body of the vessel. The chassis portion 10 is located relative to the left hull and the right hull 12 by locating arrangements 14 such as the front leading arm shown in FIG. 1 although many other suitable locating arrangements are known and can be used instead. The chassis portion is supported relative to the left hull and right hull 12 by front suspension rams 16 and back suspension rams 17 located between the hulls and the chassis portion in any effective manner.

The term position is intended to mean location and the term attitude is intended to mean orientation or absolute angle. For example, the pitch attitude of the chassis portion is directly related to the absolute pitch angle of the deck of the chassis portion. However, where multiple positions are known, they can define or be used to calculate an attitude, orientation or angle.

Figure 2:
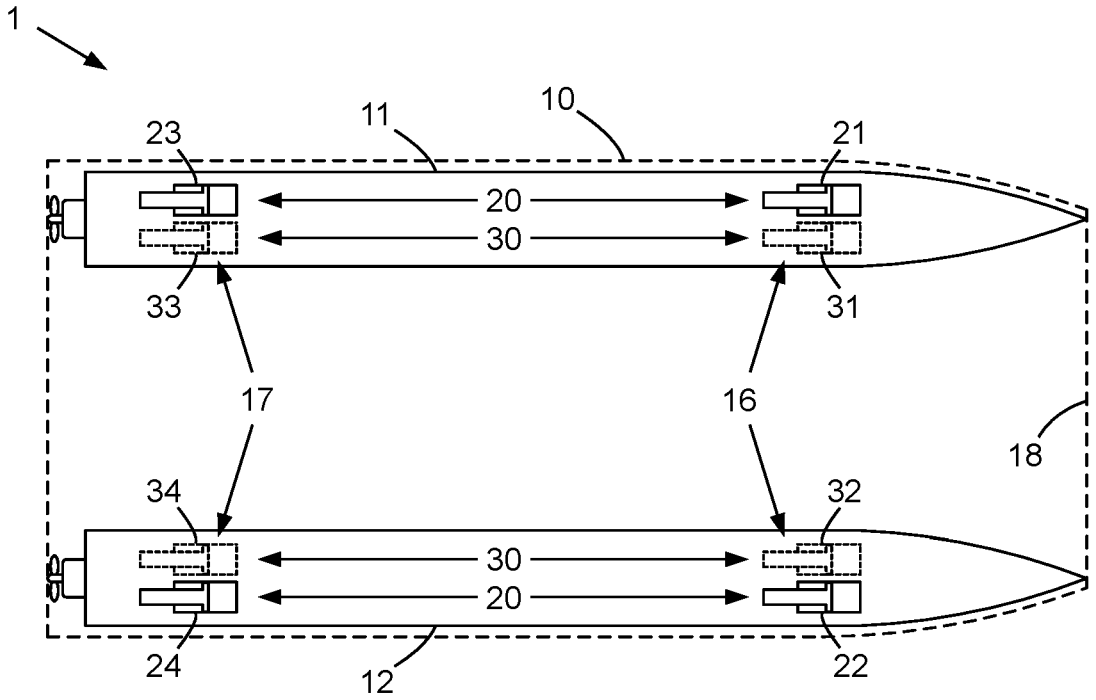
FIG. 2 is a schematic plan view of a vessel according to an embodiment of the present invention.

FIG. 2 shows the vessel in plan view with the chassis portion 10 in dashed lines which sits largely above the left hull 11 and the right hull 12, although the chassis portion could include a water engaging portion of a trimaran rather than the illustrated catamaran. The invention can also be applied to quadrimarans, i.e., vessels with four hulls such as a front left, front high, back left and back right hull.

The front and back suspension rams 16, 17 each include supports 20, which together with a controller (not shown) and diagonal actuating arrangements (between the support rams shown in FIG. 3), form a deck attitude control system. The front and back suspension rams 16, 17 can optionally also each include damping rams 30 shown in dashed lines. So, as shown in FIG. 2 the front suspension rams 16 can include a front left support ram 21, an optional front left damper ram 31, a front right support ram 22 and an optional front right damper ram 32. Similarly, the back suspension rams 17 can include a back left support ram 23, an optional back left damper ram 33, a back right support ram 24 and an optional back right damper ram 34.

It can be beneficial to use damper rams that provide some support, for example, the damper rams may also be additional low stiffness support rams that provide less roll and/or pitch stiffness than conventional independent coil springs. This can be through using additional low stiffness supports such as independent air springs with a low variation in stiffness through the centre of the stroke, or using additional gas volumes for fluid pressure accumulators of hydraulic rams. For example, the supports can vary in static, or non-dynamic pressure by less than 25%, preferably less than 20% more preferably less than 15% and most preferably less than 10%, through a range of at least 50%, preferably at least 60%, more preferably at least 70% and most preferably at least 80% of a travel of the support. Alternatively, when the damper rams of the deck attitude control system are being used to control the attitude of the chassis portion of the vessel, the supports 20 can be interconnected to reduce or substantially remove their roll and/or pitch stiffness. However, the additional low stiffness supports either need to have a very low stiffness or if they have sufficient stiffness to provide static levelling when the vessel is not in use, the additional supports need to be switchably interconnected so their stiffness in at least one suspension mode (roll, pitch or heave) can be removed or significantly reduced to reduce the forces required by the deck attitude control system. Similarly, the damping of any dampers in parallel with the support rams is ideally switchable so it can be reduced or minimised at least in the directions that the controller is attempting to extend or contract the individual support rams of the suspension rams.

Figure 3:
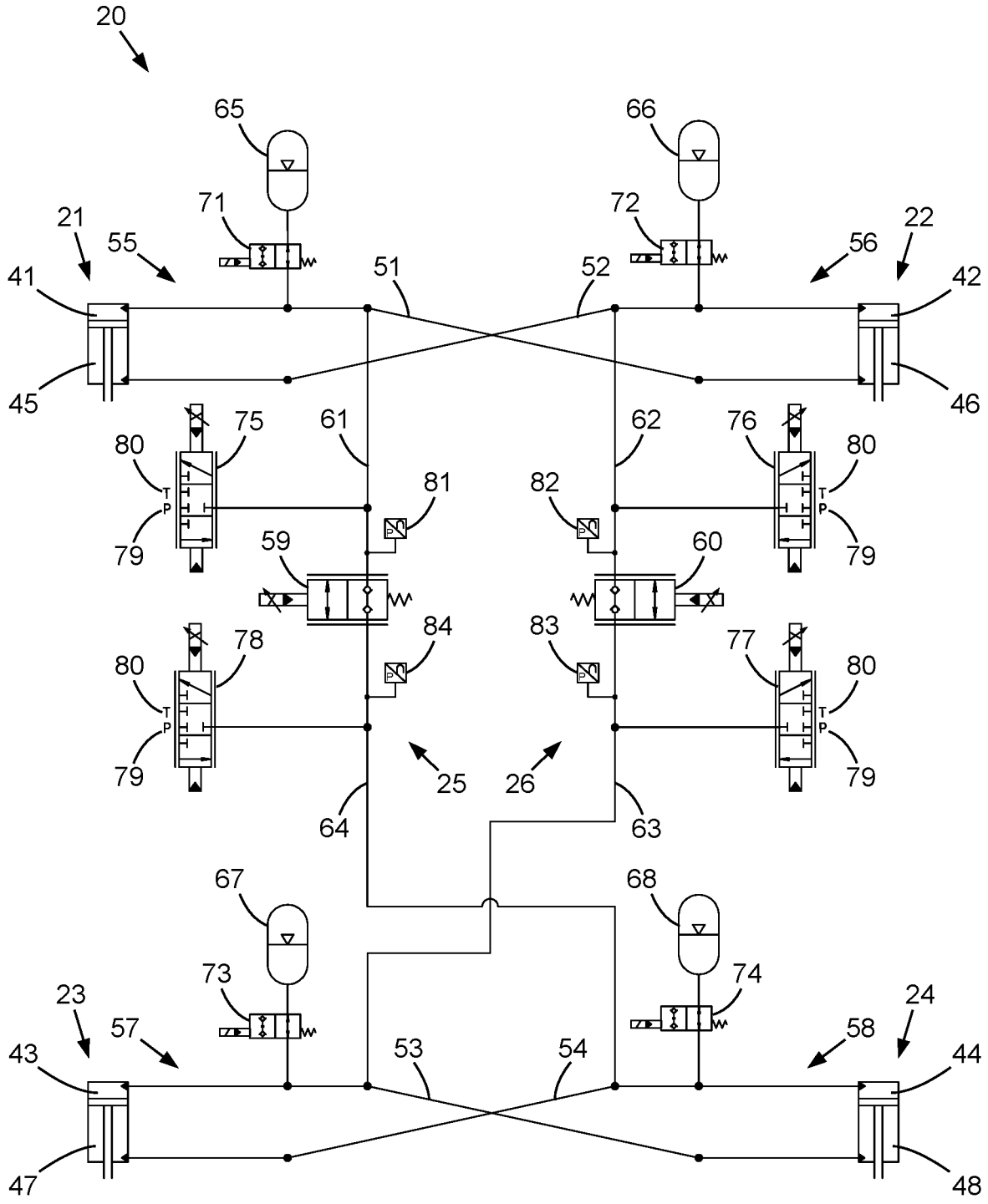
FIG. 3 is a schematic view of support arrangement of a suspension according to an embodiment of the present invention.

FIG. 3 shows an arrangement of the supports 20 in which each support ram 21, 22, 23, 24 includes a respective compression chamber 41, 42, 43, 44 and a respective rebound chamber 45, 46, 47, 48. The front left support compression chamber 41 is in fluid communication with the front right support rebound chamber 46 through the front left lateral cross-connection 51 forming a front left support compression volume 55. Similarly, the front right support compression chamber 42 is in fluid communication with the front left support rebound chamber 45 through the front right lateral cross-connection 52 forming a front right support compression volume 56. The back left support compression chamber 43 is in fluid communication with the back right support rebound chamber 48 through the back left lateral cross-connection 53 forming a back left support compression volume 57 and the back right support compression chamber 44 is in fluid communication with the back left support rebound chamber 47 through the back right lateral cross-connection 54 forming a back right support compression volume 58. The front left, front right, back left or back right support accumulator 65, 66, 67, 68 is connected to the respective support compression volume 55, 56, 57, 58 via a respective support accumulator valve 71, 72, 73, 74.

The support accumulator valves 71, 72, 73, 74 are preferably lockout valves, but can be or include any form of damper valve or variable restriction. For example, a restrictor or bleed valve can be used in parallel with the lockout valve, or the lockout valve can have a known leak rate which allows pressure between the respective accumulator and the respective support compression volume to equalise over time to prevent sudden motions of the chassis portion when the accumulator lockout valve is opened. Alternatively, the control for the accumulator lockout valve can be pulsed when opening to gradually reduce any pressure differential before fully opening the valve for passive operation of the supports.

Such a laterally cross-connected arrangement of double-acting rams front and back will inherently provide a higher roll stiffness than the pitch and heave stiffness which is generally beneficial for a passive suspension system for a vessel. However, by driving fluid between diagonally opposite compression volumes, the pitch and roll of the vessel can be adjusted, which is of particular benefit for active control of the attitude of the chassis portion of the vessel. So, the front left diagonal conduit 61 is connected to and forms part of the front left support compression volume 55, the front right diagonal conduit 62 is connected to and forms part of the front right support compression volume 56, the back left diagonal conduit 63 is connected to and forms part of the back left support compression volume 57 and the back right diagonal conduit 64 is connected to and forms part of the back right support compression volume 58.

If pumps are the only means used to drive the flow between the front left and back right support compression volumes 55, 58 and/or between the front right and back left support compression volumes 56, 57, the arrangement can be inefficient due for example to parasitic power losses from the pumps. So, the present invention selectively permits flow between the front left and back right support compression volumes 55, 58 through the first diagonal support interconnection valve 59 and selectively permits flow between the front right and back left support compression volumes 56, 57 through the second diagonal support interconnection valve 60. While the suspension system of the vessel is in passive operation, the diagonal support interconnection valves are normally closed, so the supports provide a common heave and pitch stiffness with a higher roll stiffness. However, when the deck attitude control system is in operation, i.e. when the attitude of the chassis portion is being controlled through controlling the flow between the front left and back right support compression volumes 55, 58 and the flow between the front right and back left support compression volumes 56, 57, the first and second diagonal support interconnection valves 59, 60 can be opened when appropriate to permit flow and allow or generate the roll and/or pitch motions required by the controller.

Respective front left, front right, back left and back right support compression volume pressure sensors 81, 82, 83, 84 are shown in the respective diagonal conduits 61, 62, 63, 64 on either side of the first or second diagonal support interconnection valve 59, 60. While the controller (not shown) can calculate the required flows across the first or second diagonal support interconnection valves 59, 60, the respective support compression volume pressure sensors 81, 82, 83, 84 can be used to determine if the flow can be achieved through passive pressure differential across the first or second diagonal support interconnection valve 59, 60, or whether additional energy is required to drive the required rates of fluid flow. The respective support compression volume pressure sensors 81, 82, 83, 84 can also be used to estimate a support ram force in each of the respective support rams 21, 22, 23, 24 and/or forces in the mounts of the respective support rams can be measured.

Alternatively or additionally, individual respective support compression chamber pressure sensors can be used, individual respective support rebound chamber pressure sensors can be used and individual respective support accumulator pressure sensors can be provided to measure the pressure in the respective support accumulators. Respective support ram displacement, velocity and/or acceleration sensors can also be provided but are not shown in FIG. 3.

When the controller determines that additional energy is required to drive the required rates of fluid flow between one or both of the diagonally opposite pairs of support compression volumes, the relevant diagonal support interconnection valve 59 and/or 60 is closed, then the relevant front left, front right, back left or back right support compression volume control valve 75, 76, 77, 78 is commanded to communicate the respective support compression volume with a pressure source 79 or a reservoir or tank 80. In this way fluid can be released, from for example, the front left support compression volume 55 through the front left support compression volume control valve 75 and simultaneously added into the back right support compression volume 58 through the back right compression volume control valve 78, this effectively driving fluid flow from the front left support compression volume 55 to the back right support compression volume 58.

Alternatively, the front left, front right, back left and back right support compression volume control valves 75, 76, 77, 78 can be replaced by a first pump (not shown) between the front left diagonal conduit 61 and the back right diagonal conduit 64 (i.e., in parallel with the first diagonal support interconnection valve 59) and by a second pump between the front right diagonal conduit 62 and the back left diagonal conduit 63 (i.e. in parallel with the second diagonal support interconnection valve 60). While this can appear more efficient than the valve arrangement shown in FIG. 3 which releases pressurised fluid from one of the support compression volumes into a lower pressure (or atmospheric pressure) reservoir or tank and draws pressurised fluid from a pressure source, in practice the parasitic losses of a suitable pump arrangement (such as a bi-directional variable displacement pump) when idling ready for immediate use can be considerable.

A further advantage of the control valve arrangement of the first and second diagonal actuating arrangements shown in FIG. 3 is that the same control valve arrangement can be used to maintain the pressure and fluid volumes in the front left, front right, back left and back right support compression volumes 55, 56, 57, 58. Therefore an additional suspension fluid volume maintenance system can be omitted or is not required, although it can always be provided for redundancy to enable a limp-home mode of the suspension.

Figure 4:
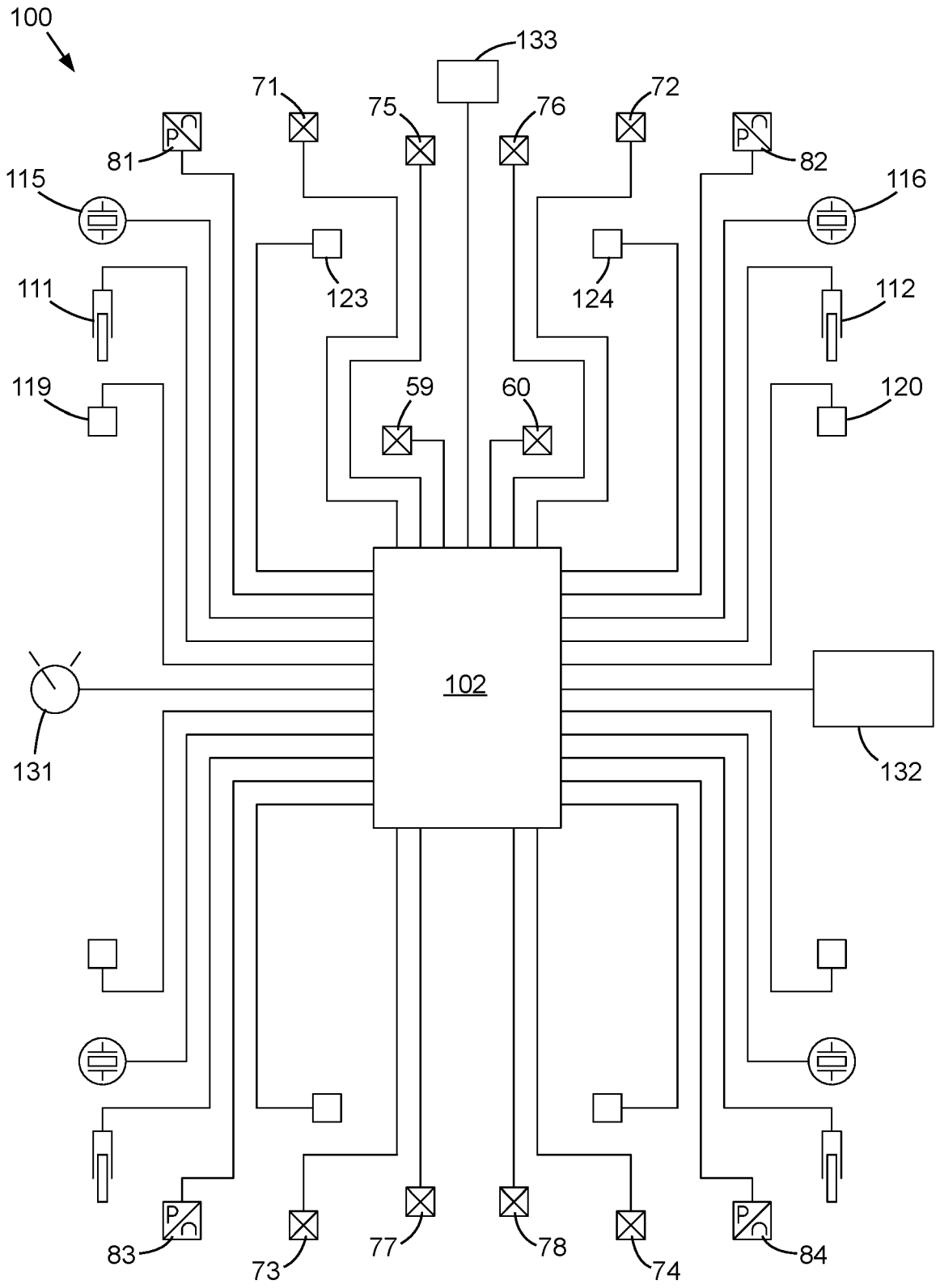
FIG. 4 is a schematic view of control components of a deck attitude control system of an embodiment of the present invention.

In FIG. 4 the control components of the deck attitude control system 100 are shown, i.e., the controller 102, sensors and valves. The rams and conduits of FIG. 3 are omitted in FIG. 4 for clarity, but like valves are given like reference numerals. For each respective front left, front right, back left and back right support ram (not shown) a respective displacement sensor 111, 112, 113, 114 is shown in communication with the controller 102. A respective support ram force sensor 115, 116, 117, 118 can be provided to enable the force in the support ram to be measured, or alternatively, additional pressure sensors on or near the compression and rebound chambers of the respective support ram can be used to calculate the force in the respective ram. A respective hull accelerometer 119, 120, 121, 122 can be mounted on or near the respective support ram on the hull portion of the ram or on the hull itself to provide signals to the controller indicative of acceleration in or about one or more axis.

One or more accelerometers are provided on the chassis portion of the vessel. In this example shown in FIG. 4, chassis accelerometers 123, 124, 125, 126 are mounted on the chassis near each support ram, but any number of accelerometers can be used in any location. For example, one multi-axis accelerometer may be used in any position to measure the linear and rotational accelerations on the chassis portion in place of or in addition to a number of accelerometers placed at locations dispersed around the chassis portion. For example, the controller may include a multi-axis accelerometer or gyroscope sensor integrated into the board or case of the controller.

A mode switch 131 or other input means such as a selection on a touch screen or a voice control can be used to change the mode of the controller. The controller 102 is connected to the support accumulator valves 71, 72, 73, 74, the compression control volume valves 75, 76, 77, 78 and the first and second diagonal support interconnection valves 59, 60 and controls them in response to the inputs from the sensors and the mode switch. Status and/or warnings and other information can be displayed on a display 132 which can be specific to the deck attitude control system or part of a user interface used by other systems on the vessel.

For example, when the mode switch 131 is in a normal or transit mode, the deck attitude control system 250 can be inactive and the supports operating in a passive mode of higher roll stiffness than the heave and pitch stiffness. When the mode switch is in the active or transfer mode, the deck attitude control system is active and the controller is processing inputs from the sensors, including a bow sensor 133 which can sense load on the bow when in contact with a pylon, or additionally or alternatively can include an optical or relative proximity sensor able to detect the position of a reference point on the pylon relative to the bow of the vessel.

When in the active deck attitude control mode or transfer mode, the controller 102 closes the support accumulator valves 71, 72, 73, 74 to reduce resilience in the support volumes and enable more efficient, faster control. The controller determines whether the support rams need to individually extend or contract and if sufficient pressure drop exists across the diagonal support interconnection valves 59, 60 as detected by the respective support compression volume pressure sensors 81, 82, 83, 84, opens the appropriate diagonal support interconnection valve(s) 59, 60. Where insufficient pressure exists to transfer fluid diagonally between the support rams, the controller closes the diagonal support interconnection valve(s) 59, 60 and actuates the respective support compression volume control valves 75, 76, 77, 78 as required to effectively transfer fluid between diagonally opposite support compression volumes to adjust the roll and pitch attitude of the chassis portion of the vessel.

When the mode switch is in the normal or transit position there can still be some control of the attitude of the chassis portion, but not pitch and roll control of the chassis attitude. For example, the mode switch can include three positions: the active or transfer position described above where the deck attitude control system is operational; a roll adjusting or transit mode; and a passive position.

Figure 5:
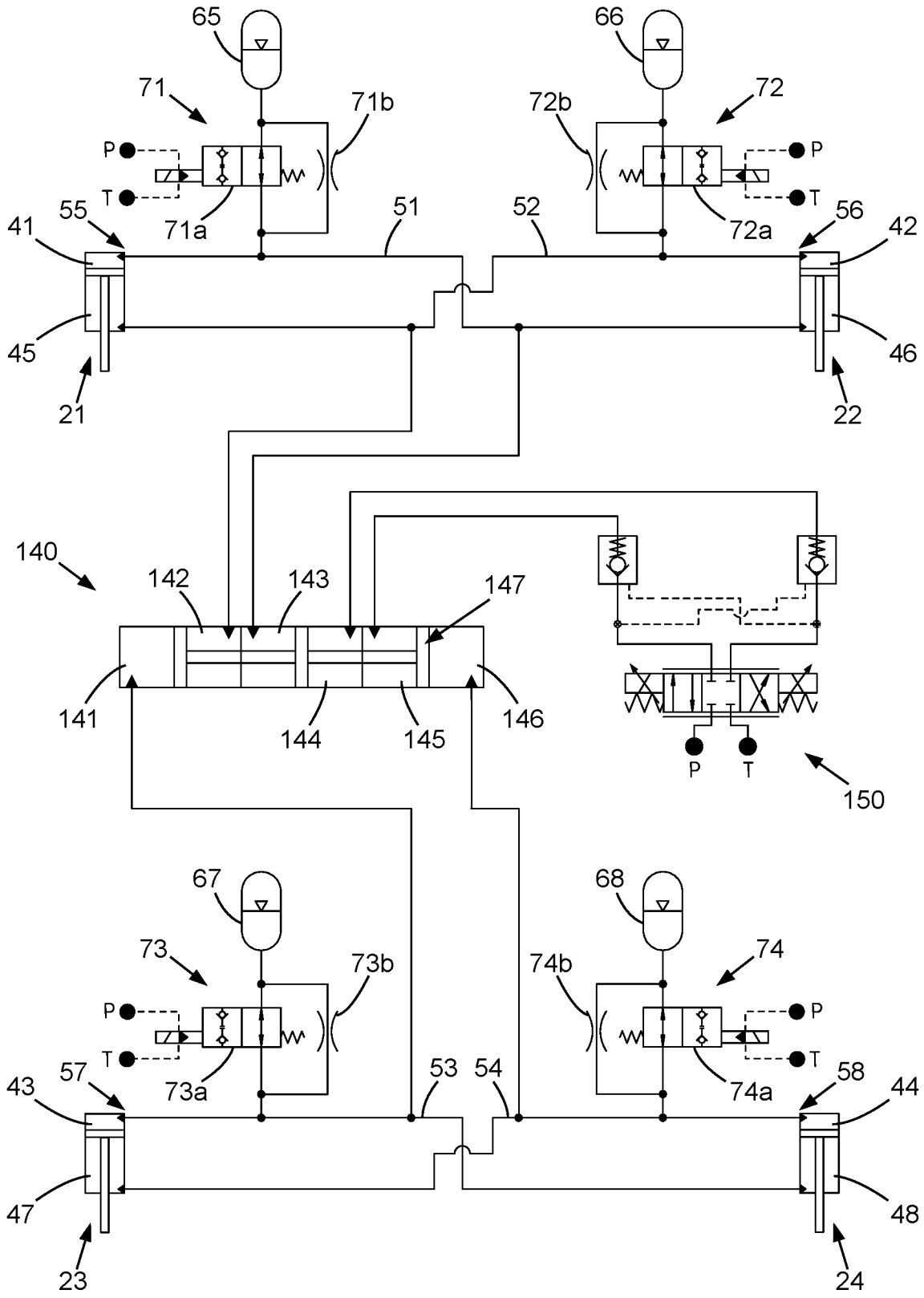
FIG. 5 is a schematic view of a roll displacement arrangement applied to the support rams according to an embodiment of the present invention.

FIG. 5 shows the configuration of the suspension system in roll adjusting mode. The support compression volumes are individually connected to a roll displacer 140, with the first and second actuating arrangements being omitted in this Figure for clarity as although they are still present, they are not operated in this roll adjusting mode and remain closed. The roll attitude of the chassis portion can be controlled to roll the chassis into turns, such as described in the Applicant's U.S. Pat. No. 10,286,980.

The roll displacer 140 comprises three axially aligned major chambers, each having a piston disposed within forming three pairs of minor chambers: the first and second chambers 141, 142; the third and fourth chambers 143, 144; and the fifth and sixth chambers 145, 146. The piston of the central major chamber is connected by a respective rod to pistons in the two outer major chambers. The rod can continue on to pass through the first and sixth chambers 141, 146 and out through the ends of the two outer major chambers, which can provide all equal effective piston areas in each minor chamber and allow the position of the piston rod assembly 147 to be easily ascertained relative to the major chambers. However, there is a high pressure differential across the rod seals from the end minor (first and sixth) chambers 141, 146 to atmosphere, so preferably the roll displacer construction is as shown.

Different effective piston areas between the minor chambers can be provided by using different diameter major chambers or different diameter rods as is known in general multi-chamber hydraulic cylinder construction. This can be beneficial to provide a ratio between front to back pressure changes and fluid volume displacements with motions of the piston rod assembly 147. In FIG. 5, the larger first and sixth chambers 141 and 146 are respectively connected to the back left and back right support compression volumes 57, 58. These chambers are equal in pressure area and vary in volume inversely, so for example, as the first chamber 141 increases in volume, the sixth chamber 146 decreases in volume. The second and third chambers 142, 143 of the roll displacer 140 are respectively connected to the front right and front left support compression volumes 56, 55. As the first chamber 141 increases in volume, taking fluid from the back left support compression volume 57: the third chamber 143 also increases in volume, taking fluid from the front left support compression volume 55; the second chamber 142 decreases in volume supplying fluid to the front right support compression volume 56; and the sixth chamber decreases in volume supplying fluid to the back right support compression volume 58. This motion of the piston rod assembly 147 therefore generates a roll of the chassis to the left or into a left hand turn. Conversely, motion of the piston rod assembly 147 in the opposite direction would generate a roll to the right or into a right hand turn.

The fourth and fifth chambers 144, 145 of the roll displacer 140 are driven by the directional control valve arrangement 150. One of the chambers can selectively be pressurised and urged to increase in volume as the other chamber is allowed to drain through a respective pilot assisted check valve, with fluid being trapped in the fourth and fifth chamber 144, 145 by the check valves when the directional control valve is not powered. Other methods of adjusting the fluid volume in the fourth and fifth chamber, and therefore driving the piston rod assembly 147 to drive the roll attitude of the chassis, can be used.

As noted in relation to FIG. 3, the respective support accumulator valves 71, 72, 73, 74 are preferably lockout valves, but can be or include any form of damper valve or variable restriction. So, also shown in FIG. 5 each of the respective front left, front right, back left and back right support accumulator valves 71, 72, 73, 74 comprises a respective support accumulator lockout valve 71*a*, 72*a*, 73*a*, 74*a* in parallel with a respective support accumulator bypass bleed 71*b*, 72*b*, 73*b*, 74*b* which is an orifice or other restriction to allow pressure difference between the respective accumulator and the respective support compression volume to gradually reduce. The purpose of this is to provide a passive means of reducing said pressure difference over time to allow the parallel lockout valve to be opened without suddenly changing the volume of fluid in the respective support compression volume as such sudden changes can generate undesirable accelerations of the chassis portion.

The support accumulator lockout valves 71*a*, 72*a*, 73*a*, 74*a* are shown in FIG. 5 as solenoid pilot operated valves with P being a connection to a source of pressurised fluid and T being connection to a tank or reservoir. The directional control valve arrangement 150 can also use a solenoid pilot operated valve.

Modifications and variations as would be apparent to a skilled addressee are deemed to be within the scope of the present invention.

The invention claimed is:

1. A suspension system for a vessel, the vessel having at least one left hull, at least one right hull, and a chassis portion, the suspension system comprising:

locating arrangements for constraining motion of the at least one left hull and the at least one right hull in at least a longitudinal and a lateral direction relative to the chassis portion; and a plurality of supports for at least partially supporting the chassis portion relative to the at least one left hull and the at least one right hull;

the plurality of supports including a front left support ram including a front left support compression chamber forming at least part of a front left compression volume, a front right support ram including a front right support compression chamber forming at least part of a front right compression volume, a back left support ram including a back left support compression chamber forming at least part of a back left compression volume, and a back right support ram including a back right support compression chamber forming at least part of a back right compression volume;

the front left support ram and the back left support ram being connected between the chassis portion and longitudinally spaced points on the at least one left hull;

the front right support ram and the back right support ram being connected between the chassis portion and longitudinally spaced points on the at least one right hull;

a front left diagonal conduit connected to and forming part of the front left compression volume, a front right diagonal conduit connected to and forming part of the front right compression volume, a back left diagonal conduit connected to and forming part of the back left compression volume, a back right diagonal conduit connected to and forming part of the back right compression volume;

the front left compression volume and the back right compression volume are selectively interconnected by a first diagonal support interconnection valve between the front left diagonal conduit and the back right diagonal conduit; and the front right compression volume and the back left compression volume are selectively interconnected by a second diagonal support interconnection valve between the front right diagonal conduit and the back left diagonal conduit;

a deck attitude control system comprising a controller, at least one force sensor, at least one pressure sensor, at least one acceleration or position sensor, a first diagonal actuating arrangement for controlling fluid flow between the front left compression volume and the back right compression volume, and a second diagonal actuating arrangement for controlling fluid flow between the front right compression volume and back left compression volume;

the first diagonal actuating arrangement including the first diagonal support interconnection valve and the second diagonal actuating arrangement including the second diagonal support interconnection valve;

the controller configured to control the first and second diagonal actuating arrangements in dependence on signals from the at least one force sensor, at least one pressure sensor, at least one acceleration or position sensor to control a position of at least one point on the chassis portion relative to at least one reference.

2. The suspension system as claimed in claim 1 wherein the front left support ram, the front right support ram, the back left support ram, and the back right support ram each includes a respective rebound chamber.

3. The suspension system as claimed in claim 2 wherein the front left support ram, the front right support ram, the back left support ram, and the back right support ram are respectively interconnected by respective lateral cross connections; wherein the front left support compression chamber of the front left support ram is connected to a front right support rebound chamber of the front right support ram by a front left compression conduit forming part of the front left compression volume; wherein the front right support compression chamber of the front right support ram is connected to a front left support rebound chamber of the front left support ram by a front right compression conduit forming part of the front right compression volume; wherein the back left support compression chamber of the back left support ram is connected to a back right support rebound chamber of the back right support ram by a back left compression conduit forming part of the back left compression volume; and wherein the back right support compression chamber of the back right support ram is connected to a back left support rebound chamber of the back left support ram by a back right compression conduit forming part of the back right compression volume.

4. The suspension system as claimed in claim 1 wherein the plurality of supports further includes independent support rams.

5. The suspension system as claimed in claim 1 wherein the suspension system further includes damper rams.

6. The suspension system as claimed in claim 1 wherein the first diagonal actuating arrangement includes a front left compression volume control valve and a back right compression volume control valve; wherein the second diagonal actuating arrangement includes a front right compression volume control valve and a back left compression volume control valve; and wherein each respective compression volume control valve selectively communicates the respective compression volume with a pressure source or a tank.

7. The suspension system as claimed in claim 1 wherein the first diagonal actuating arrangement includes a first pump to drive fluid between the front left compression volume and the back right compression volume; and wherein the second diagonal actuating arrangement includes a second pump to drive fluid between the front right compression volume and the back left compression volume.

8. The suspension system as claimed in claim 1 wherein the selective interconnection is open during at least one deck attitude control system operation and closed when the deck attitude control system is not in use.

9. The suspension system as claimed in claim 1 wherein the at least one force sensor, the at least one pressure sensor, and the at least one acceleration or position sensor provides at least one respective output signal from which a force in the respective support ram is calculated.

10. The suspension system as claimed in claim 1 wherein the at least one force sensor, the at least one pressure sensor, the at least one acceleration or position sensor provides at least one respective output signal indicative of a displacement.

11. The suspension system as claimed in claim 1 wherein the at least one reference comprises one of a point on an object, an absolute point in space, and an absolute orientation.

* * * * *